United States Patent [19]

Harris

[11] Patent Number: 4,857,871

[45] Date of Patent: Aug. 15, 1989

[54] MAGNETIC FIELD-TUNABLE FILTER WITH PLURAL SECTION HOUSING AND METHOD OF MAKING THE SAME

[76] Inventor: David L. Harris, 2837 SW. 219th Ave., Hillsboro, Oreg. 97123

[21] Appl. No.: 264,725

[22] Filed: Oct. 31, 1988

[51] Int. Cl.[4] ..... H01P 1/202; H01P 1/218; H01P 7/06

[52] U.S. Cl. ..... 333/202; 333/207; 333/223; 333/235

[58] Field of Search ..... 333/202, 206, 207, 208, 333/209, 248, 245, 219, 222, 223, 227, 231, 235; 29/600

[56] References Cited

U.S. PATENT DOCUMENTS 3,102,244 8/1963 Seidel ..... 333/243 X 4,334,201 6/1982 Shores ..... 333/202

4,742,355 5/1988 Wolfson et al. ..... 333/248 X

*Primary Examiner*—Marvin L. Nussbaum

[57] ABSTRACT

A tunable ferrimagnetic resonator containing microwave filter with a plural piece housing is described. First and second body laminations are provided with channels and openings which form passageways and resonator receiving cavities when the laminations are assembled. These passageways and openings are preferably formed by chemical milling. Closure elements or shims overlay and close the ends of the resonator cavities. The body laminations and closure elements are of a nonmagnetic metal and are typically formed from flat thin sheets of material. Cover laminations, such as of plastic, clamp the closure and body laminations together and provide strength to the overall housing structure. Microwave filters of this invention are capable of being tuned up to 40 Gigahertz and higher.

16 Claims, 3 Drawing Sheets

MAGNETIC FIELD-TUNABLE FILTER WITH PLURAL SECTION HOUSING AND METHOD OF MAKING THE SAME

BACKGROUND OF THE INVENTION

This invention relates generally to magnetic field-tunable microwave filters and in particular to such filters utilizing ferrimagnetic resonator elements, such as of yttrium-iron-garnet (YIG).

One type of known YIG filter utilizes a single piece housing in which to mount YIG spheres, coupling loops, coaxial cables, and their associated mounting parts. With this approach, relatively large holes, in comparison to a typical coupling loop wire diameter, are drilled through the housing in order to permit coaxial cables to be fed to the YIG sphere cavity or cavities in the housing. If the transition from the coaxial cable center conductor to a coupling loop is made at the cavity edge, the coupling to spurious magnetostatic modes is greatly increased. If, on the other hand, the transition is made too far away from the edge, inductance is added to the filter which causes the input coupling to change as the filter frequency is tuned. These single piece housing microwave filters are limited to relatively low maximum tuning frequencies.

U.S. Pat. No. 4,334,201 of Shores discloses a YIG band pass filter having a housing which is split into two sections or rings. The two section technique of the Shores patent facilitates the placement of small passages and holes within the housing. These small holes accommodate the various components of the filter. This patent specifically discloses molding the housing components out of powdered metal, such as German Silver. Without providing any further details, the Shores patent mentions that any other suitable material and process may be used to fabricate the housing rings. Filters formed of molded powdered metallic material have been tunable in general only to about 2 to 20 Gigahertz. To significantly extend the frequency range using molded powdered metal is not believed possible. To extend the frequency range using powdered metal and machining, instead of molding, would require an extremely skilled machinist. An filter manufacturing technique which relies upon the skill of a machinist does not reliably result in tunable filters with consistent performance characteristics.

In devices made in accordance with U.S. Pat. No. 4,334,201, metallic shims are used to cover and close the YIG sphere containing cavities. These shims are gold plated and conform to the shape of magnet pole piece receiving recesses found in the components of the filter housing. Respective pole pieces of a magnet are pressed against these shims to hold them in place and close the YIG resonator cavities. As a result, the magnetic material forming the pole pieces is placed under mechanical stress, which interferes with tuning linearity of the filter, especially at higher frequencies. Therefore, tuning of these filters is unpredictable. In addition, shims of this type provide limited sealing of the ends of the YIG filter sphere cavities. Also, in these devices the gap between the pole pieces across the shims and housing components was about 0.065 inches.

Filter housing components have also been formed by injection molding of plastic and coating these plastic parts with metal and by injection molding of metal. Again, the maximum frequencies to which such filters have been tunable are about the same as have been achieved using molded powdered metal components.

Therefore, a need exists for an improved microwave filter of this type, and for a method of manufacturing such a filter, which is directed towards overcoming these and other disadvantages of the prior art.

SUMMARY OF THE INVENTION

The present invention is a new microwave filter of the type utilizing one or more ferrimagnetic resonator elements and specifically relates to such a filter with a new type of housing and to a method of manufacturing the housing.

In accordance with one aspect of the present invention, the housing has first and second nonmagnetic metal housing body laminations which are joined together to form a housing body. One or more openings are chemically milled through these body laminations with the openings through the laminations being aligned to form cavities. These cavities receive the ferrimagnetic resonator or resonators included in the filter. In addition, the adjoining surfaces of each of these laminations have corresponding channels chemically milled therein so that, when the laminations are joined, these channels form passageways for the coupling components of the filter. By using chemical milling techniques, precise alignment of these passageways and openings is achieved. As a result, filters of the present invention have been tuned to operate at up to 40 Gigahertz and higher.

In accordance with another aspect of the present invention, the body forming laminations are sandwiched or clamped between respective cover laminations. These cover laminations may comprise injection molded nonmetallic components, such as of plastic. Nonmetallic cover laminations do not support eddy currents, which could otherwise interfere with filter operation. In addition, the use of cover laminations for rigidifying purposes permits the use of relatively thin metal body housing laminations. That is, the filter does not depend upon the thickness of the body housing laminations for rigidity.

As a further aspect of the present invention, a respective nonmagnetic metal resonator cavity closure sheet is positioned between each of the cover laminations and the adjoining body lamination. These closure sheets close the ferrimagnetic resonator containing cavities of the body laminations. These sheets may extend substantially coextensively with the surface area of the body laminations to more effectively seal the ends of the ferrimagnetic resonator containing cavities. In addition, these sheets may be attached to the jackets of coaxial cables included in the filter for more effective grounding of these cables.

It is therefore one object of the present invention to provide an improved microwave filter utilizing ferrimagnetic elements and an improved method of manufacturing such a filter.

A more specific object of the present invention is to provide an improved housing for such a filter and an improved method of manufacturing such a housing.

Another object of the present invention is to provide such a filter which is tunable to extremely high frequencies.

Still another object of the present invention is to provide such a filter which is relatively easy to mass produce while maintaining desired filter performance characteristics.

Another object of the present invention is to provide a filter which requires less power to operate at any given frequency.

Yet another object of the present invention is to provide a filter of this type which is relatively inexpensive to manufacture.

These and other objects, features and advantages of the present invention will become apparent with reference to the following description and drawings.

DETAILED DESCRIPTION OF THE PREFERRED EMBODIMENT

For purposes of convenience, the preferred embodiment of a microwave filter in accordance with the present invention is described as one utilizing yttrium-iron-garnet (YIG) spheres. This is not to be construed as a limitation because other ferrimagnetic resonators may be used, such as resonators of lithium-aluminum-ferrite, nickel-zinc-ferrite and barium-zinc-ferrite. As known in the art, the use of resonators of different materials affects the bandwidth characteristics of the resulting microwave filter.

As is well known, when a D.C. magnetic field is applied to yttrium-iron-garnet, the material exhibits a high-Q resonance at a frequency proportional to the strength of the magnetic field. Known as the gyromagnetic frequency, this frequency can be changed by changing the strength of the magnetic field. In a typical prior art microwave filter, such as shown in U.S. Pat. No. 4,334,201, one, two, three or more cascaded filter sections are provided with each section containing a YIG sphere. The filter sections have coupling loops arranged so that their axes are perpendicular to each other and to the magnetic field applied by pole pieces of a magnet across the YIG spheres. When the YIG spheres are not subject to a magnetic field, energy is not transferred between the coupling loops because the loop axes are perpendicular to each other and there is no interaction with the YIG spheres. When a D.C. magnetic field is applied to the spheres and the frequency of an RF signal applied to the coupling loops is the same as the gyromagnetic frequency, energy is transferred between the coupling loops.

The present invention is a filter with an improved housing which, because of its structure and method of construction, overcomes many of the problems inherent in the prior art.

Figure 1:
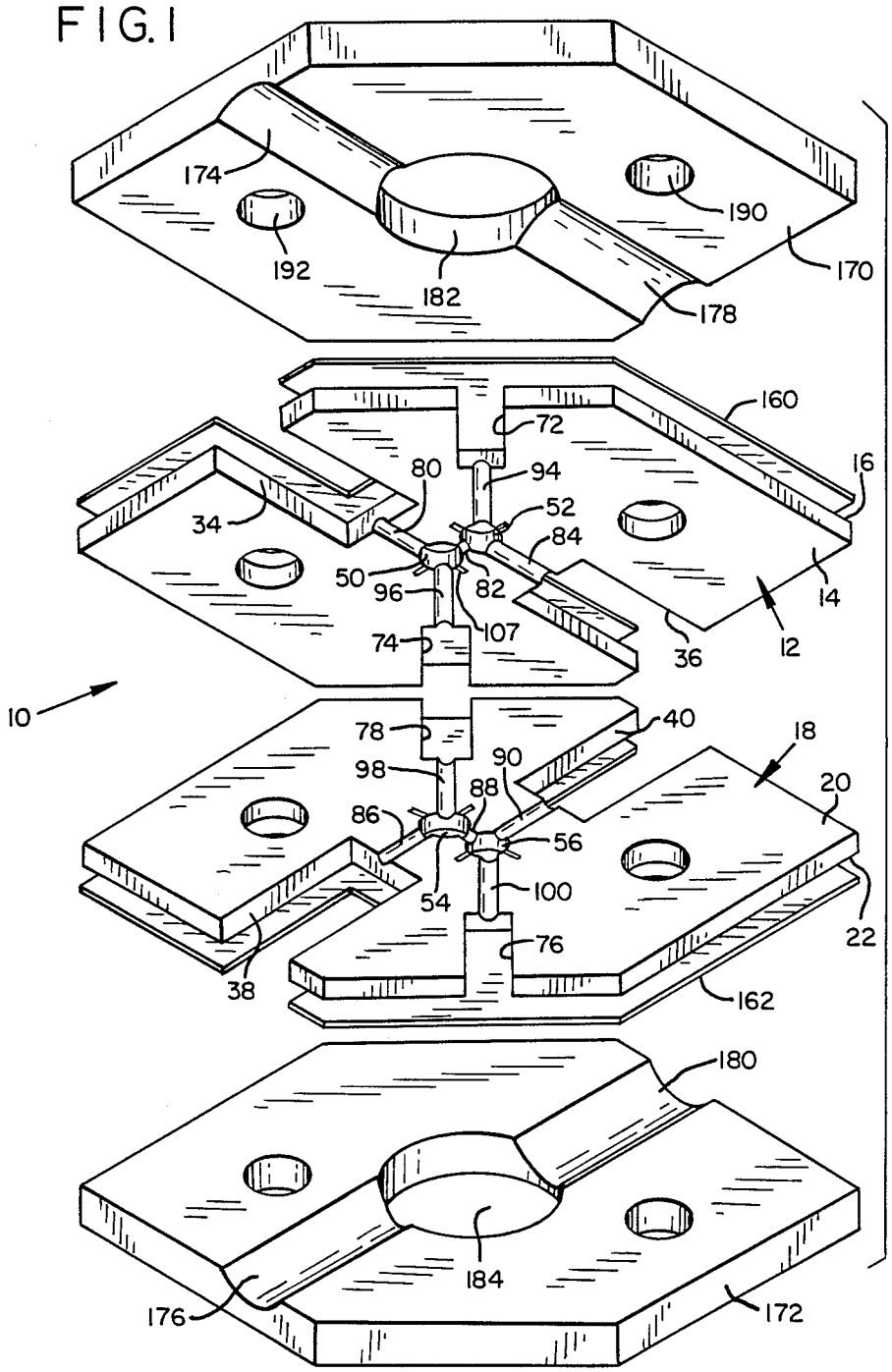
FIG. 1 is an exploded isometric view of one form of a filter housing in accordance with the present invention.

FIG. 1 shows an exploded view of one form of a microwave filter housing 10 in accordance with the present invention. Housing 10 includes a first body forming lamination 12 having opposed surfaces 14, 16 and a second body forming lamination 18 with opposed surfaces 20, 22. The laminations 12, 18 are extremely thin, ranging typically up to no more than about 0.04 inches thick and more preferably from about 0.008 inches thick to about 0.02 inches thick. These body components are formed of a nonmagnetic metal. When laminations 12, 18 are manufactured using a chemical milling procedure as set forth below, they are preferably formed from sheets of metal, in which case the surfaces 14, 16 and 20, 22 are substantially planar and parallel to one another. Also, by making the laminations 12, 18 of a homogenous elemental material, such as copper, as opposed to of an alloy, more sharply defined passageways and openings of extremely small size can be chemically milled at precise locations in these laminations.

Figure 3:
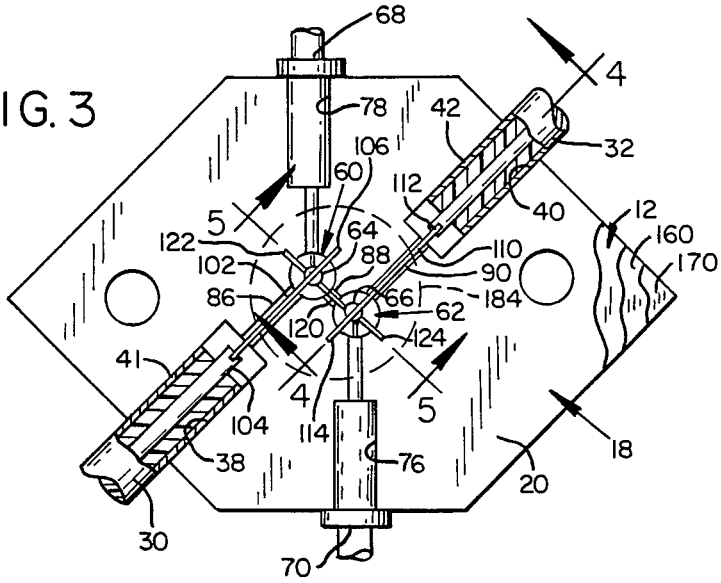
FIG. 3 is a top plan view of the portion of the filter housing shown in FIG. 2 with filter components mounted thereto.

Assuming the combined thickness of laminations 12, 18 is smaller than the diameter of input and output coaxial cables (i.e., cables 30, 32 in FIG. 3) coupled to the microwave filter, the body lamination 12 is provided with a first rectangular opening 34 and a second rectangular opening 36. Similarly, the body lamination 18 is provided with a first rectangular opening 38 and a second rectangular opening 40. When the two body laminations are assembled with surface 14 against surface 20, the pairs of openings 34, 38 and 36, 40 are aligned to provide respective openings for receiving the input and output coaxial cables. As best seen in FIG. 3, the outer jacket 40 of the input coaxial cable 30 is connected, as by soldering, to these body laminations to provide electrical grounding of the microwave filter. Similarly, the jacket 42 of output coaxial cable 32 is secured to the body laminations. Of course, if the coaxial cables happen to be smaller in diameter than the total thickness of the two body laminations 12, 18, then the openings 34–38 are typically replaced with concave channels. These channels mate with one another to form coaxial cable receiving holes in the body.

The body lamination 12 is provided with first and second circular openings 50, 52 (FIG. 1) extending through the body between the surfaces 14, 16. Similarly, the body lamination 18 is provided with openings 54, 56. When the body laminations 12, 18 are assembled, the pairs of openings 50, 54 and 52, 56 are aligned to form resonator element receiving cavities 60, 62, as shown in FIG. 3. YIG spheres 64, 66 are supported in the respective cavities 60, 62 by conventional support elements 68, 70, which may comprise ceramic rods. Assuming these rods are of a greater diameter than the total thickness of the body laminations 12, 18, rectangular openings 72, 74 (FIG. 1) are provided in body lamination 12 and similar openings 76, 78 are provided in lamination 18. When the body laminations are assembled, the respective pairs of openings 72, 76 and 74, 78 form openings for receiving the YIG sphere supporting rods 68, 70, as best seen in FIG. 3. Openings 72–78 are also typically replaced with concave channels in the event the total thickness of the two body laminations is greater than the diameter of the sphere supporting rods 68, 70.

The housing shown in the figures and described to this point is for a two-stage filter and is presented for purposes of illustration only. Any number of filter stages may be utilized to suit each particular application.

As shown in FIG. 1, small elongated concave coupling loop receiving channels 80, 82, 84 are provided in the surface 14 and extend, respectively, from opening 34 to cavity forming opening 50, from opening 50 to cavity forming opening 52, and from opening 52 to opening 46.

Similar concave channels 86, 88 and 90 are provided in the surface 20 of lamination 18. The channels 86, 88 and 90 extend, respectively, from opening 38 to cavity forming opening 54, from opening 54 to cavity forming opening 56, and from opening 56 to opening 40. The pairs of channels 80, 86 and 82, 88, and 84, 90 mate with one another when the housing is assembled to provide passageways for coupling loops used in the filter as explained below. Similarly, concave channels 94, 96 and 98, 100 in surfaces 14, 20 provide passageways through which the rods 68, 70 extend to the resonator receiving cavities.

Figure 2:
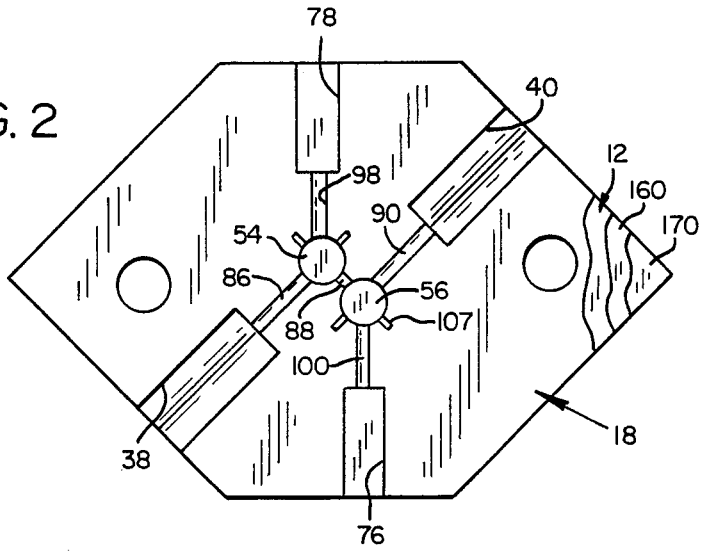
FIG. 2 is a top plan view of the filter housing of the present invention with several laminations broken away to reveal channels and openings in one of the body laminations of the housing.

As shown in FIG. 3, an input coupling loop conductor 102 is connected, as by welding, to a projecting portion 104 of the central conductor of the input coaxial cable 30. This connection is conveniently made in a chamber defined by the openings 34, 38. The input coupling loop 102 is supported so as to not touch the walls of channels 80, 86 and the opposite end of the coupling loop is secured at 106 between the body laminations. As shown in FIGS. 1 and 2, shallow recesses, one being numbered as 107, are provided to receive the ends of the coupling loops. The output coupling loop 110 is similarly connected at one end to a projecting portion 112 of the central conductor of the output coaxial cable 32. Output coupling loop 110 is supported and secured at its opposite end 114 between the body laminations. The output coupling loop 110 also does not touch the channel defining walls 84, 90 of the body laminations. The inner stage coupling loop 120 is anchored at its respective ends to the body laminations 12, 18 and is supported so that it also does not touch the walls of channels 82, 88. The diameter of the coupling loop conductors and of the passageways are sized to provide an impedance match to the impedance of the input and output cables 30, 32.

Figure 4:
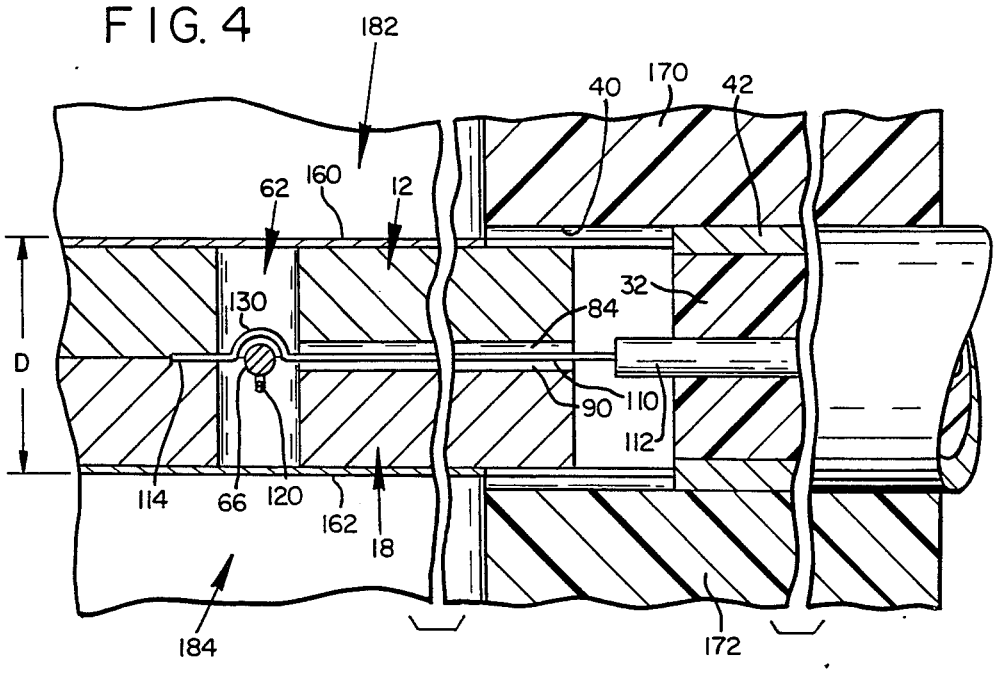
FIG. 4 is a cross-sectional view taken along lines 4—4 of FIG. 3.
Figure 5:
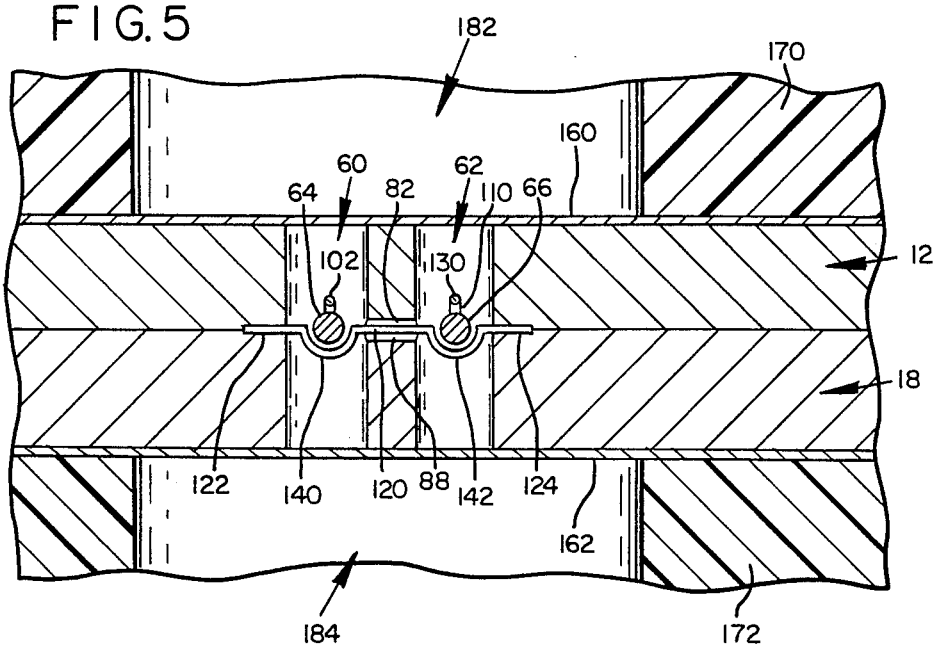
FIG. 5 is a cross-sectional view taken along lines 5—5 of FIG. 3.

As best seen in FIG. 4, the output coupling loop 110, as it passes through the resonator cavity 62 is formed in the shape of a loop 130 spaced from the YIG sphere 66 in the cavity. The input coaxial cable and input coupling loop are similarly configured and therefore are not shown in detail. As shown in FIG. 5, the inner stage coupling loop conductor 120, where it passes through the respective resonator chamber 60, 62, is also shaped in the form of loops 140, 142 spaced from the respective resonator spheres 64, 66. The axis of the loop of the input coupling conductor is orthogonal to the axis of loop 140 the axes of loops 140 and 142 are parallel, and the axis of loop 130 of the output coupling conductor is orthogonal to the axis of loop 142.

Referring again to FIG. 1, a resonator cavity closure element, in this case a sheet or shim 160 overlies the surface 16 of body lamination 12. A similar closure element 162 is disposed adjacent the surface 22 of body lamination 18. Elements 160, 162 are provided with cutouts or openings, as required, to accommodate the coaxial cables. Typically the closure elements 160 162 are formed of an extremely thin metal foil, such as from 0.001 to 0.002 inches thick. As a specific example, berillium copper may be used to provide a somewhat stiff foil which does not sag into the resonator receiving cavities 60, 62. The housing also has covering or clamping laminations 170, 172. The elements 12, 18, 160 and 162 are sandwiched or clamped between the covering laminations 170, 172 when the microwave filter is assembled.

The covering laminations 170, 172 reinforce and strengthen the filter assembly and thus permit the use of very thin inner laminations as these thin lamiations need not provide rigidity to the filter structure. In addition, cover elements 170, 172 are typically formed of plastic, as by injection molding, or some other nonmetallic material. Therefore, eddy currents are not established in these cover elements which could othrwise interfere with the overall performance of the microwave filter. Pairs of channels 174, 176 and 178, 180 in the respective cover elements 170, 172 provide clearance for the input and output coaxial cables.

An opening 182 is provided in element 170 while a similar opening 184 is provided in the element 172. These openings are sized and shaped to overlie the resonator cavities 60, 62 (see FIG. 3) and permit the positioning of respective pole pieces of an electromagnet through these openings and adjacent to the inner laminations. The illustrated openings 182, 184 are shown as circular, but may be bevelled or otherwise shaped to conform to the particular configuration of the magnet pole pieces being used. Because the magnet pole pieces need not be tightly pressed against shims 160, 162 to hold these elements in place, the magnet pole pieces are not placed under mechanical stress. Therefore, tuning linearity at high frequencies is enhanced.

Not only does the use of relatively thin internal components of a microwave filter permit the tuning of the filter for operation at extremely high frequencies, such as 40 to 60 Gigahertz or higher, power consumption advantages are also present with this construction. Specifically, because relatively thin components can be used for the body laminations 12, 18 and closure elements 160, 162, the distance D (FIG. 4) through these elements can be minimized. More specifically, the pole pieces of a magnet can be inserted in the openings 182, 184 adjacent to the respective closure elements 160, 162. In this case, the distance or gap between the pole pieces corresponds to the distance D. The power required for an electromagnet to reach a given frequency varies as the square of the gap between the pole pieces. Because the present construction allows extremely thin elements, the distance D can be relatively short. This results in lower power consumption even for microwave filters operated at lower than the maximum frequencies possible with the present invention.

In addition, the adjoining surfaces of the closure elements 160, 162 and body laminations 12, 18 are typically each plated with a thin layer of gold to prevent oxidation of these surfaces. Therefore, when these elements are clamped together by cover laminations 170, 172, effective sealing of the ends of the resonator cavities 60, 62 against energy leakage is accomplished because of the gold against gold contact. This sealing is also enhanced because the closure elements extend beyond the edges of the openings 182, 184, and in the illustrated embodiment because elements 160,162 are substantially coextensive with the adjoining surfaces of the body laminations.

Each of the components of the microwave filter housing are provided with bolt or screw receiving openings, two of these being indicated by numbers 190, 192 in component 170. These openings are aligned when the housing components are assembled and receive retaining bolts or screws that hold these components together. In addition, these housing components may be provided with alignment or fixturing pin receiving openings, not shown, through which fixturing pins extend as the components are laid on top of one another. Following the fastening of the components together by screws or bolts, the completed microwave filter is simply lifted off of the fixturing pins.

To provide microwave filters which are capable of operating at extremely high frequencies, precise positioning and formation of the resonator receiving cavities and coupling passageways is required in the thin body laminations used in such filters. In addition, extremely small diameter cavities and coupling passageways are required, as well as extremely close spacing between the cavities. As a specific example, and not to be construed as a limitation, typical dimensions of a specific microwave filter of the present invention are as follows:

Diameter of resonator cavities 60, 62—0.04 inches;
Diameter of YIG spheres 64, 66—0.015 inches;
Separation between resonator cavities 60, 62—0.005 inches;
Thickness of each body lamination 12, 18—0.02 inches;
Thickness of closure elements 160, 162—0.001 to 0.002 inches;
Diameter of coupling passageways—0.08 to 0.01 inches;
Diameter of coupling conductors —0.002 inches; Radius of loops of the coupling conductors —0.01 inches.

In the preferred method of manufacturing the body laminations, the surfaces of a sheet of copper or other material are coated with a photosensitive emulsion. A photomask is placed over the coated sheet and subjected to light. Areas, such as openings 34, 36 and 50, 51 (FIG. 1) and the boundaries of the laminations are exposed through the mask. The emulsion is then developed to expose the surface areas which are to be chemically milled. The metal sheet is then dipped in an etching solution to remove material from the sheet and leave the desired openings and to separate the laminations. Typically, many body laminations are made from a single sheet of material. In this case, small tabs are left between the laminations so that the body laminations remain temporarily interconnected on the sheet following this initial etching operation. The chemical milling procedure is then repeated to partially etch the sheet to form the concave channels in one surface of each body lamination. These two chemical milling steps may be performed in either order. Also, elements 160, 162 may be formed in the same manner. The coupling loops may also be formed by chemical milling.

Typically, lasers are used to cut the recesses 107 for receiving the ends of the coupling loop. However, laser cutting is too time consuming and provides insufficient accuracy to cut the other openings in the body laminations. Although chemical milling has previously been used to manufacture a number of devices having small apertures, such as ink jet heads and the like, and such techniques have been used in the production of conductor loops fo microwave filters, no one has heretofore thought to apply these techniques to the manufacture of microwave filter housing components.

Having illustrated and described the principles of my invention with reference to one preferred embodiment, it should be apparent to those skilled in the art that the invention may be modified in arrangement and detail without departing from these principles. For example, various approaches for mounting or connecting coaxial cables to filter housing components may be used. In addition, the center conductors of coaxial cables may be connected to the coupling loops at various locations, for example in passageways within the body laminations rather than as shown.

I claim all modifications which are within the true spirit and scope of the following claims:

1. A method of manufacturing a tunable filter comprising the steps of:

chemically milling a resonator receiving opening between opposed surfaces of each of first and second nonmagnetic metal body laminations;

chemically milling coupling structure passageway forming channels in a surface of each of the body laminations;

assembling the body laminations with the resonator receiving openings aligned to form a resonator receiving cavity, with the passageway forming channels mating to form coupling structure receiving passageways in communication with the resonator receiving cavity, with a ferrimagnetic resonator supported in the resonator receiving cavity, with a coupling loop extending through the coupling structure passageway and supported within the resonator receiving cavity for magnetic coupling to the ferrimagnetic resonator, and with the center conductors of input and output coaxial cables coupled to the coupling loop; and closing the ends of the resonator receiving cavity with metallic closure elements.

2. A method according to claim 1 including the step of clamping the closure elements and body laminations between nonmetallic cover laminations, the closure elements each having a magnet pole piece receiving opening positioned to overlie the resonator receiving cavity.

3. A method according to claim 1 in which each of the body laminations is no greater than about 0.02 inches thick.

4. A method according to claim 3 in which each of the closure elements are no more than about 0.002 inches thick.

5. A method according to claim 1 in which the resonator receiving opening is formed in a separate chemical milling step from the chemical milling step which forms the coupling structure passageway forming channels.

6. A method according to claim 1 in which plural of said resonator receiving cavities are formed by chemical milling with a ferrimagnetic resonator being positioned in each such cavity during assembly of the filter.

7. A magnetic tunable filter comprising:

a housing having a body which includes first and second body laminations of a nonmagnetic metal, each body lamination having opposed side surfaces and defining a cavity opening extending through the body lamination between the opposed side surfaces, the cavity opening of the first body lamination being aligned with the cavity opening of the second body lamination to form a resonator receiving cavity with the ends of the resonator receiving cavity exposed when the first and second body laminations are joined together, the body laminations also defining a coupling structure passageway communicating between the exterior of the body and the resonator receiving cavity when the first and second body laminations are joined;

a first ferrimagnetic resonator element supported within the resonator receiving cavity;

coupling structure means including an elongate conductor extending through the coupling structure passageway and into the resonator receiving cavity for coupling magnetically with the resonator element;

nonmagnetic metallic closure means for closing the ends of the resonator receiving cavity; and the housing also including first and second reinforcing cover laminations which are positioned to hold the body laminations therebetween, the reinforcing cover laminations each being of a nonmetallic material and having a magnet pole piece receiving opening positioned to overlie the resonator receiving cavity.

8. A magnetic tunable filter according to claim 7 in which the closure means comprise first and second nonmagnetic metallic closure elements which are each sized larger than the pole piece receiving openings, each of the closure elements being positioned between a respective one of the cover laminations and a side surface of a body laminaiion, the cover laminations holding the closure elements in position.

9. A magnetic tunable filter according to claim 8 in which the closure elements each comprise a sheets extending substantially coextensive with the side surfaces of the respective body laminations.

10. A magnetic tunable filter according to claim 7 in which the body laminations each comprise a planar sheet.

11. A magnetic tunable filter according to claim 10 in wich the body laminations are of copper.

12. A magnetic tunable filter according to claim 10 in which the body laminations are each no greater than about 0.04 inches thick.

13. A magnetic tunable filter according to claim 10 in which the body laminations are each no greater than about 0.02 inches thick.

14. A magnetic tunable filter according to claim 10 in which the body laminations are each from about 0.008 inches thick to about 0.02 inches thick:

15. A magnetic tunable filter according to claim 7 in which the closure means comprise first and second nonmagnetic metallic closure elements which are each sized larger than the pole piece receiving openings, each of the closure elements being positioned between a respective one of the cover laminations and a side surface of a body lamination, the cover laminations holding the closure elements in position, the closure elements each comprise sheets extending substantially coextensive with the side surfaces of the respective body laminations, and in which the body laminations each comprise a planar sheet.

16. A magnetic tunable filter according to claim 15 in which the body laminations are each no greater than about 0.02 inches thick, and in which the closure elements are no more than about 0.002 inches thick.

* * * * *

UNITED STATES PATENT AND TRADEMARK OFFICE

CERTIFICATE OF CORRECTION

PATENT NO. : 4,857,871

DATED : August 15, 1989

INVENTOR(S) : David L. Harris

It is certified that error appears in the above-identified patent and that said Letters Patent is hereby corrected as shown below: Title page:

Attorney, Agent, or Firm - David P. Petersen; Boulden G. Griffith

In the claims:

Claim 2 should read:

--2. A method according to claim 1 including the step of clamping the closure elements and body laminations between non-metallic cover laminations, the cover laminations each having a magnet pole piece receiving opening positioned to overlie the resonator receiving cavity.--

In claim 8, seventh line, "laminaiion" should be --lamination--.

In claim 11, second line, "wich" should be --which--.

Signed and Sealed this

Nineteenth Day of June, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,857,871

DATED : August 15, 1989

INVENTOR(S) : David L. Harris

It is certified that error appears in the above-identified patent and that said Letters Patent is hereby corrected as shown below:

On the title page, add:

Assignee: Tektronix, Inc., Beaverton, Oregon

Signed and Sealed this

Eleventh Day of December, 1990

*Attest:*

HARRY F. MANBECK, JR.

*Attesting Officer*

*Commissioner of Patents and Trademarks*